US008918946B2

(12) United States Patent
Park

(10) Patent No.: US 8,918,946 B2
(45) Date of Patent: Dec. 30, 2014

(54) MOLAR-DEDICATED TOOTHBRUSH

(71) Applicant: Geun Gab Park, Geoje-si (KR)

(72) Inventor: Geun Gab Park, Geoje-si (KR)

( * ) Notice: Subject to any disclaimer, the term of this patent is extended or adjusted under 35 U.S.C. 154(b) by 0 days.

(21) Appl. No.: 13/756,160

(22) Filed: Jan. 31, 2013

(65) Prior Publication Data

US 2013/0205527 A1 Aug. 15, 2013

(30) Foreign Application Priority Data

Feb. 13, 2012 (KR) ..... 10-2012-0014306

(51) Int. Cl.
*A46B 9/04* (2006.01)

(52) U.S. Cl.
CPC ..... *A46B 9/04* (2013.01); *A46B 2200/1066* (2013.01)
USPC ..... 15/167.1

(58) Field of Classification Search
USPC ..... 15/167.1; D4/104, 110
See application file for complete search history.

(56) References Cited

U.S. PATENT DOCUMENTS 2,697,239 A * 12/1954 Funk ..... 15/167.1
2,771,624 A * 11/1956 Ripper ..... 15/167.2
3,474,481 A * 10/1969 Schiff et al. ..... 15/167.1
D289,231 S * 4/1987 Fleisher ..... D4/110
4,672,706 A * 6/1987 Hill ..... 15/167.1
6,070,286 A * 6/2000 Cardarelli ..... 15/167.1
D431,722 S * 10/2000 Harada ..... D4/112
6,397,858 B1 * 6/2002 Cubillo-Buron ..... 132/308
2012/0030891 A1 * 2/2012 Bauernfeind et al. ..... 15/167.1

FOREIGN PATENT DOCUMENTS

| | | | |
|---|---|---|---|
| JP | 3163229 | | 9/2010 |
| JP | 2011030950 | | 2/2011 |
| KR | 30-0293922 S | * | 3/2002 |
| KR | 30-0357957 | * | 7/2004 |
| KR | 200424441 | | 8/2006 |

* cited by examiner

*Primary Examiner* — Randall Chin
(74) *Attorney, Agent, or Firm* — IPLA P.A.; James E. Bame

(57) ABSTRACT

A molar-dedicated toothbrush is provided to remove dental plaque formed in a molar tooth because the head part of the toothbrush can approach the side of a molar tooth located at the inner most part, approach the side of a molar tooth, or approach the side of a molar tooth adjacent to an extracted molar tooth in a surface-contact manner. The molar-dedicated toothbrush of the present invention includes a toothbrush body configured to be able to be held, a toothbrush head provided at a front part of the toothbrush body and rounded in a U shape so that the toothbrush head can come into a surface-contact with the side of a molar tooth, and a toothbrush tuft configured to brush the molar tooth.

2 Claims, 7 Drawing Sheets

MOLAR-DEDICATED TOOTHBRUSH

CROSS-REFERENCES

Applicant claims foreign priority under Paris Convention to Korean Patent Application No. 10-2012-0014306, filed Feb. 13, 2012, with the Korean Intellectual Property Office, where the entire contents are incorporated herein by reference.

BACKGROUND OF THE INVENTION

1. Field of the Invention

The present invention relates to a molar-dedicated toothbrush and, more particularly, to a molar-dedicated toothbrush capable of easily removing dental plaque formed in a molar tooth because the head part of the toothbrush is rounded in a U shape and thus the head part can approach the side of a molar tooth located at the inner most part, in particular, a distal face in a surface-contact manner, approach the side of a molar tooth, in particular, a gap between the lingual side face of a molar tooth and a lingual-side tooth in a surface-contact manner, or approach the side of a molar tooth adjacent to an extracted molar tooth, in particular, the mesial face of a tooth at the back of an extracted part and the distal face of a tooth at the front of the extracted part in a surface-contact manner.

2. Description of the Related Art

A toothbrush refers to a brush used to brush teeth and basically includes a body having a straight-line and pole shape, a head formed at the front part of the body, and a toothbrush tuft provided in the head.

In the conventional toothbrush, not only the body, but also the head integrally formed with the body are formed in a straight line. Accordingly, the conventional toothbrush can reach the buccal side of a molar tooth easily, but is problematic in that it is difficult to brush the side of a molar tooth located at the inner most part, in particular, the distal face. Or, the conventional toothbrush is problematic in that it is difficult to brush the side of a molar tooth, in particular, a gap between the lingual-side teeth of molar teeth.

Furthermore, if a molar tooth is extracted, dental plaque and tartar are formed in the side of a molar tooth adjacent to the extracted molar tooth. Likewise, in this case, the conventional toothbrush is problematic in that it is difficult to brush the side of the molar tooth.

There has recently been introduced an electric toothbrush having a head formed in a disk shape so that the side of a molar tooth can be easily accessed. However, a toothbrush head in which a toothbrush tuft has been planted does not easily access a tooth in a surface-contact manner, and the tooth is abraded due to a side effect although the tooth is easily accessed. In particular, the tuft of the electric toothbrush rarely accesses a gap between the lingual-side teeth of molar teeth. Furthermore, the electric toothbrush is problematic in that the electric toothbrush must be supplied with power and it is more expensive than a common toothbrush.

SUMMARY OF THE INVENTION

Accordingly, the present invention has been made keeping in mind the above problems occurring in the prior art, and an object of the present invention is to provide a molar-dedicated toothbrush capable of easily removing dental plaque formed in a molar tooth because the head part of the toothbrush can approach the side of a molar tooth located at the inner most part, in particular, a distal face in a surface-contact manner, approach the side of a molar tooth, in particular, a gap between the lingual side face of a molar tooth and a lingual-side tooth in a surface-contact manner, or approach the side of a molar tooth adjacent to an extracted molar tooth, in particular, the mesial face of a tooth at the back of an extracted part and the distal face of a tooth at the front of the extracted part in a surface-contact manner.

In order to achieve the above object, the present invention provides a molar-dedicated toothbrush, including a toothbrush body configured to be able to be held, a toothbrush head provided at the front part of the toothbrush body and rounded in a U shape so that the toothbrush head can come into a surface-contact with the side of a molar tooth, and a toothbrush tuft configured to brush the molar tooth.

In accordance with an exemplary characteristic of the present invention, the front part of the toothbrush body is formed at a tilt angle of 5° to 30°, and the toothbrush head is formed at a tilt angle of 5° to 30° from the front part of the toothbrush body.

In accordance with a more preferred characteristic of the present invention, the central part of the toothbrush body is formed at a tilt angle of 1° to 90°.

DESCRIPTION OF REFERENCE NUMERALS OF PRINCIPAL ELEMENTS IN THE DRAWINGS

| | |
|---|---|
| 1, 1': molar-dedicated toothbrush | 10: toothbrush body |
| 20: toothbrush head | 30: toothbrush tuft |

DETAILED DESCRIPTION OF THE INVENTION

Some exemplary embodiments of the present invention are described in detail with reference to the accompanying drawings.

Figure 1:
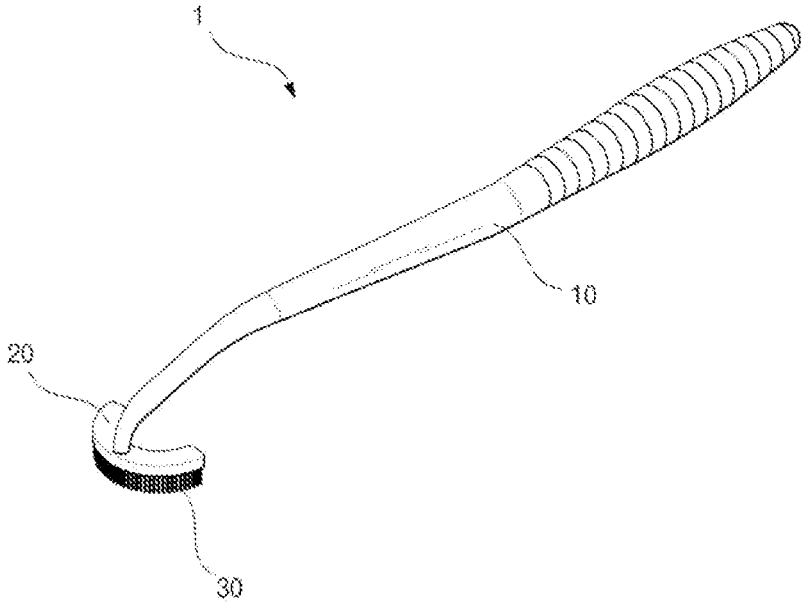
FIG. 1 is a perspective view of a molar-dedicated toothbrush in accordance with an embodiment of the present invention.
Figure 2:
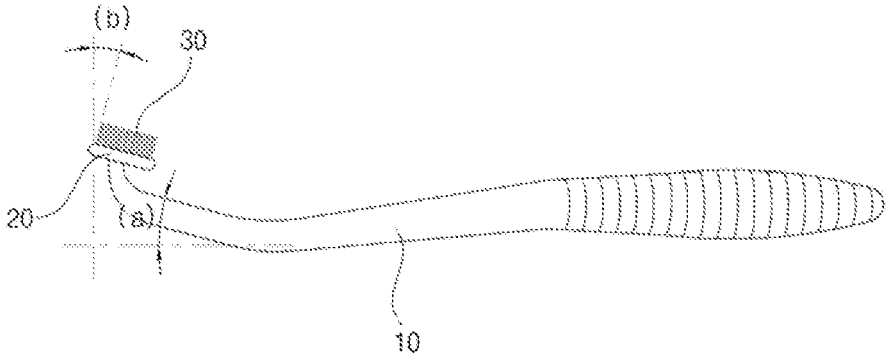
FIG. 2 is a side view of the molar-dedicated toothbrush in accordance with an embodiment of the present invention.
Figure 3:
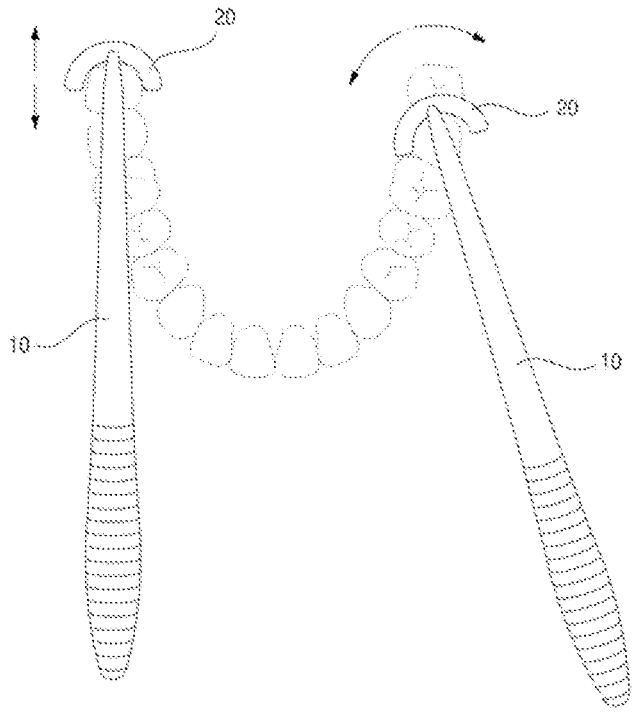
FIGS. 3 and 4 show states in which the molar-dedicated toothbrush in accordance with an embodiment of the present invention is used.
Figure 4:
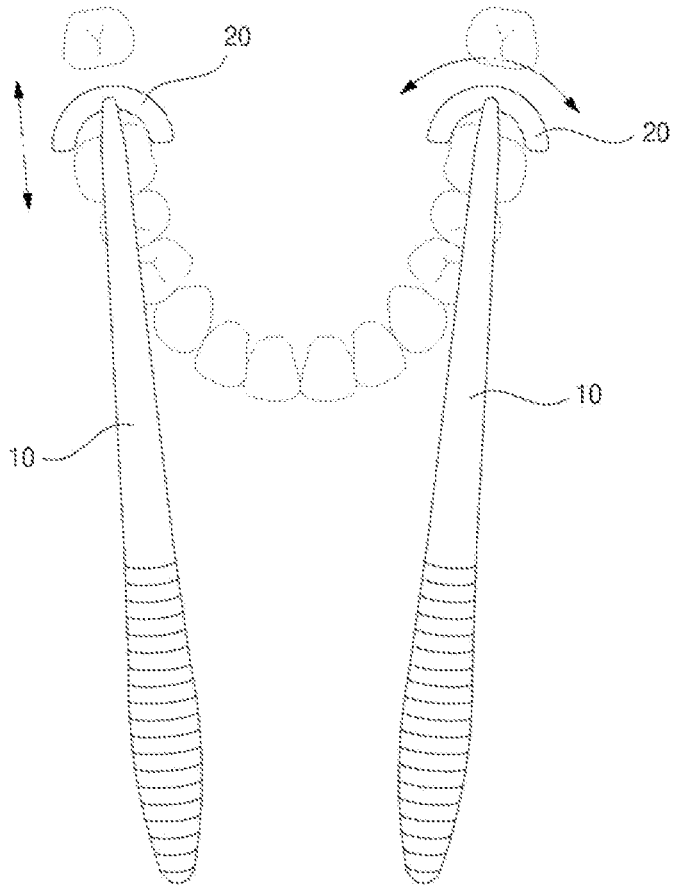

FIG. 1 is a perspective view of a molar-dedicated toothbrush in accordance with an embodiment of the present invention, FIG. 2 is a side view of the molar-dedicated toothbrush in accordance with an embodiment of the present invention, and FIGS. 3 and 4 show states in which the molar-dedicated toothbrush in accordance with an embodiment of the present invention is used.

The molar-dedicated toothbrush 1 in accordance with an exemplary embodiment of the present invention includes a toothbrush body 10 configured to be able to be held, a toothbrush head 20 provided at the front part of the toothbrush body 10 and rounded in a U shape so that the toothbrush head 20 is able to come into a surface-contact with the side of a molar tooth, and a toothbrush tuft 30 configured to brush the molar tooth.

The toothbrush body 10 is a part held by a user in order to brush teeth and formed in a linear pole shape. A rubber member is attached to the part held by a user in order to prevent sliding and increase holding power.

The shape of the toothbrush body 10 described above is already known in the art in various ways. One of the prior arts, such as those described above, is selectively used. In the present invention, however, the front part side of the toothbrush body 10, that is, a part close to the toothbrush head 20 to be described later, is formed at a tilt angle of 5° to 30° (a). Here, the direction of the tilt is that the toothbrush is upwardly curved so that the toothbrush tuft 30 to be described later is toward the sky when the toothbrush is placed on the bottom as shown in FIG. 2. In this case, the toothbrush head 20 and the toothbrush tuft 30 can easily reach the inside of a molar tooth.

Meanwhile, the toothbrush head 20 is provided at the front part of the toothbrush body 10. The toothbrush tuft 30 is provided in the toothbrush head 20, and the toothbrush head 20 is rounded in a U shape so that it can come into a surface-contact with the side of a molar tooth. That is, since the toothbrush head 20 is rounded in a U shape having a groove formed inwardly, the toothbrush head 20 is placed so that a molar tooth from which dental plaque will be removed is inserted into the groove. Accordingly, when the toothbrush is weakly swept downward with weak force and strongly swept upward with strong force, dental plaque formed in a gap between teeth can be easily removed. The size of the toothbrush head 20 can be modified in various ways so that the toothbrush head 20 can be selectively used depending on the size of a tooth. Furthermore, the toothbrush head 20 is formed at a tilt angle of 5° to 30° (b) from the front part of the toothbrush body 10 shown in FIG. 2. Accordingly, the toothbrush head 20 and the toothbrush tuft 30 that have reached the inside of a molar tooth can be easily inserted into the inside of the molar tooth.

As shown in FIG. 3, dental plaque can be removed by placing the toothbrush head 20 so that it surrounds the side of a corresponding molar tooth from which the dental plaque will be removed and then moving the toothbrush body 10 so that the toothbrush head 20 is rotated left and right. Dental plaque may be removed by placing a corresponding molar tooth from which the dental plaque will be removed within the U-shaped space unit formed in the toothbrush head 20 and then moving the toothbrush body 10 so that the toothbrush head 20 is moved back and forth.

Furthermore, as shown in FIG. 4, if the mesial face of a molar tooth located in the rear of an extracted part is sought to be brushed, dental plaque can be removed by placing the toothbrush head 20 in the extracted part and then moving the toothbrush head 20 left and right so that the top of the toothbrush tuft 30 can brush the mesial face of the molar tooth located in the rear of the extracted part. If the distal face of a molar tooth located in front of an extracted part is sought to be brushed, dental plaque may be removed by placing the toothbrush head 20 within the extracted part and then moving the toothbrush head 20 back and forth so that the lower side of the toothbrush tuft can brush the distal face of the molar tooth located in front of the extracted part.

Next, the toothbrush tuft 30 is included in the toothbrush head 20. The toothbrush tuft 30 functions to directly brush a molar tooth. The toothbrush tuft 30 is made of fine brushes so that the toothbrush tuft 30 can easily enter between teeth in order to easily remove dental plaque and reduce the abrasion of teeth. The toothbrush tuft 30 can include any one of conventional toothbrush tufts, and a detailed description thereof is omitted for simplicity.

Figure 5:
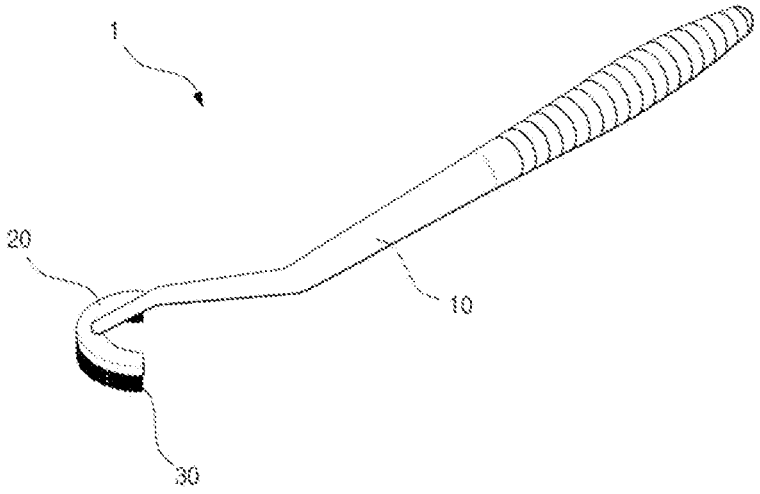
FIG. 5 is a perspective view of a molar-dedicated toothbrush in accordance with another embodiment of the present invention.
Figure 6A:
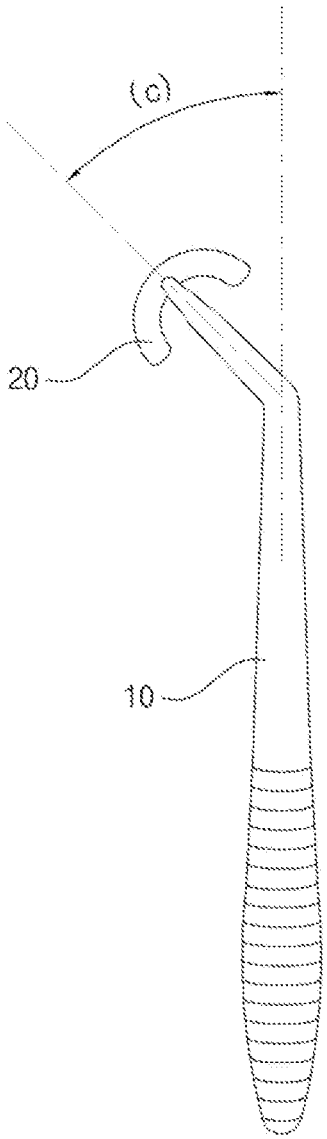
FIGS. 6*a* and 6*b* are plan views of the molar-dedicated toothbrush in accordance with another embodiment of the present invention.
Figure 6B:
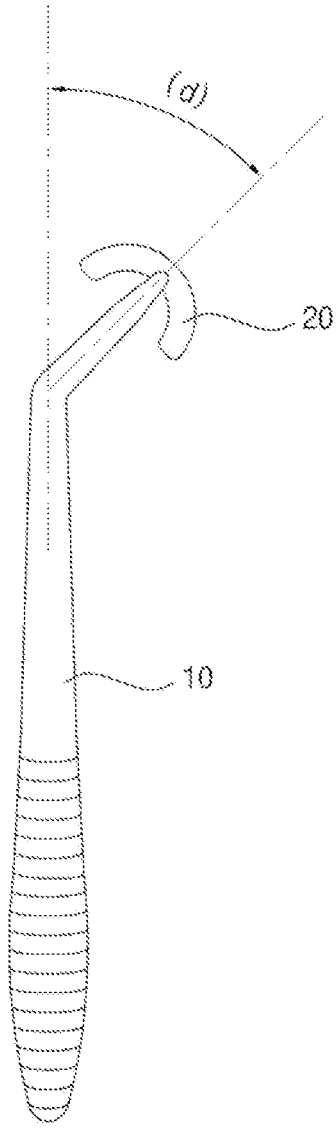
Figure 7:
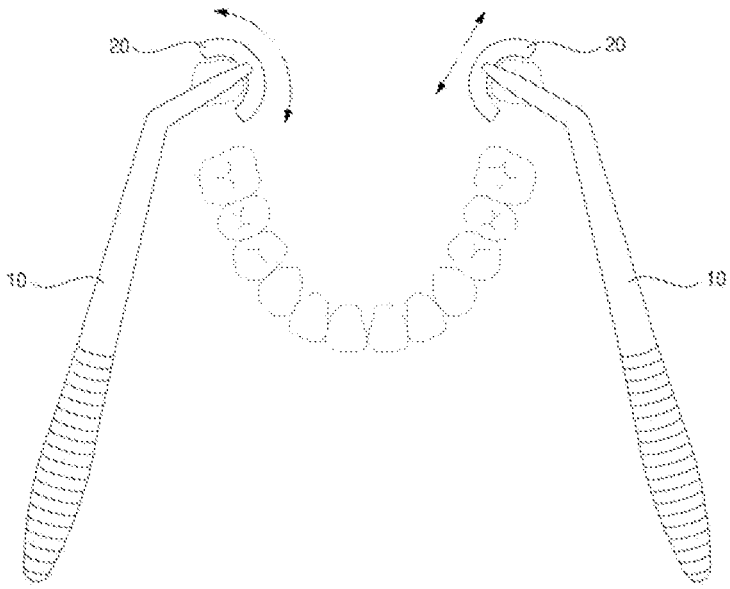
FIGS. 7 and 8 show states in which the molar-dedicated toothbrush in accordance with another embodiment of the present invention is used.
Figure 8:
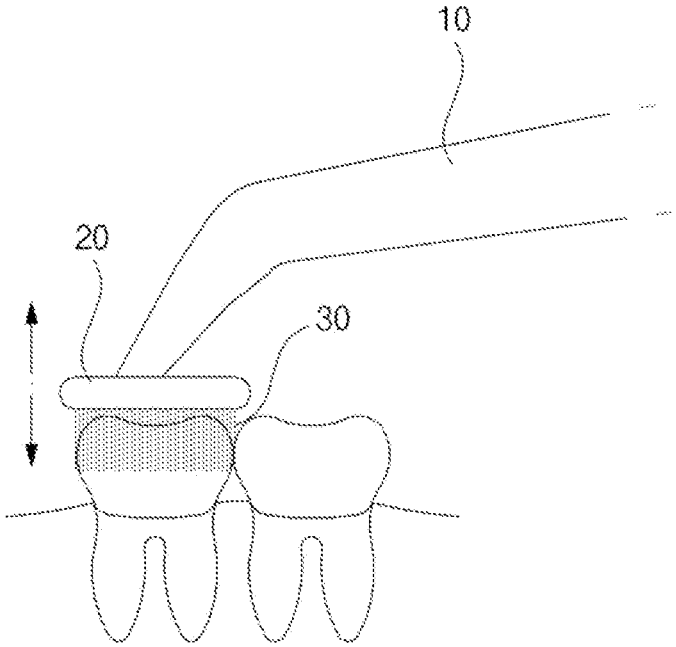

Meanwhile, FIG. 5 is a perspective view of a molar-dedicated toothbrush in accordance with another embodiment of the present invention, FIGS. 6*a* and 6*b* are plan views of the molar-dedicated toothbrush in accordance with another embodiment of the present invention, and FIGS. 7 and 8 show states in which the molar-dedicated toothbrush in accordance with another embodiment of the present invention is used.

The molar-dedicated toothbrush 1' in accordance with another embodiment of the present invention has the same construction as the molar-dedicated toothbrush 1 in accordance with the one embodiment of the present invention in that it includes a toothbrush body 10 formed to be held, a toothbrush head 20 provided at the front part of the toothbrush body 10 and rounded in a U shape so that the toothbrush head 20 can come in a surface-contact with the side of a molar tooth, and the toothbrush tuft 30 provided in the toothbrush head 20 in order to brush teeth.

However, the molar-dedicated toothbrush 1' in accordance with another embodiment of the present invention is different from the molar-dedicated toothbrush 1 in accordance with the one embodiment of the present invention in that one side of the toothbrush body 10 is formed at a tilt angle of (c) to the left as shown in FIG. 6*a* or formed at a tilt angle of (d) to the right as shown in FIG. 6*b*. Here, each of the angle (c) and the angle (d) is selectively used within a range of 1° to 90°. That is, in the case of a toothbrush used in a lingual-side molar tooth on the left side of an upper jaw and a lingual-side molar tooth on the right side of a lower jaw, the toothbrush body 10 is formed at a tilt angle of 1° to 90° to the left. Furthermore, in the case of a toothbrush used in a lingual-side molar tooth on the right side of an upper jaw and a lingual-side molar tooth on the left side of a lower jaw, the toothbrush body 10 is formed at a tilt angle of 1° to 90° to the right. In this case, dental plaque formed in a gap between the lingual side face and a lingual-side tooth can be easily removed. A tooth is brushed by moving the molar-dedicated toothbrush 1' back and forth as shown in FIG. 7 or by sweeping the molar-dedicated toothbrush 1' downward with weak force and sweeping the molar-dedicated toothbrush 1' upward with strong force as shown in FIG. 8.

As described above, in accordance with the molar-dedicated toothbrushes of the present invention, the head part of the toothbrush is rounded in a U shape. Accordingly, the head part can approach the side of a molar tooth located at the inner most part, in particular, a distal face in a surface-contact manner, approach the side of a molar tooth, in particular, a gap between the lingual side face of a molar tooth and a lingual-side tooth in a surface-contact manner, or approach the side of a molar tooth adjacent to an extracted molar tooth, in particular, the mesial face of a tooth at the back of an extracted part and the distal face of a tooth at the front of the extracted part in a surface-contact manner. There is an excellent advantage in that dental plaque formed in a molar tooth can be easily removed.

The present invention may be modified and practiced in various manners by a person having ordinary skill in the art even without departing from the gist of the claims. Accordingly, the scope of the present invention is not restricted by the aforementioned embodiments.

What is claimed is:

1. A molar-dedicated toothbrush, comprising:

a toothbrush body configured to be able to be held;

a toothbrush head provided at a front part of the toothbrush body and rounded in a U shape with both end portions of the toothbrush head pointing toward the toothbrush body so that the toothbrush head comes into a surface-contact with the rear side of a molar tooth; and a U shape toothbrush tuft provided in the toothbrush head in the U shape and configured to brush the molar tooth, wherein the U-shaped toothbrush head and the U-shaped toothbrush tuft are formed so that substantially an entire inner portion of the U shape of the toothbrush tuft comes into a surface-contact with the rear side of the molar tooth concurrently, wherein a central part of the toothbrush body is formed at a tilt angle of 1° to 90° sideways.

2. The molar-dedicated toothbrush of claim 1, wherein the front part of the toothbrush body is formed at a tilt angle of 5° to 30°, and wherein the toothbrush head is formed at a tilt angle of 5° to 30° from the front part of the toothbrush body.

* * * * *